US012637920B2

(12) United States Patent
AlTammar et al.

(10) Patent No.: US 12,637,920 B2
(45) Date of Patent: May 26, 2026

(54) USE OF HIGH-POWER ULTRASOUND FOR IMPROVED HOLE CLEANING IN DRILLING OPERATIONS

(71) Applicant: SAUDI ARABIAN OIL COMPANY, Dhahran (SA)

(72) Inventors: Murtadha J. AlTammar, Dhahran (SA); Khalid Mohammed Alruwaili, Dammam (SA); Jesus Mierez, Antalya (TR)

(73) Assignees: SAUDI ARABIAN OIL COMPANY, Dhahran (SA); REXONIC ULTRASONICS AG, Wil (CH)

( * ) Notice: Subject to any disclaimer, the term of this patent is extended or adjusted under 35 U.S.C. 154(b) by 0 days.

(21) Appl. No.: 18/457,273

(22) Filed: Aug. 28, 2023

(65) Prior Publication Data

US 2025/0075578 A1 Mar. 6, 2025

(51) Int. Cl.

| | |
|---|---|
| ***E21B 28/00*** | (2006.01) |
| ***E21B 41/00*** | (2006.01) |
| ***E21B 47/00*** | (2012.01) |

(52) U.S. Cl.

CPC ..... *E21B 28/00* (2013.01); *E21B 41/0085* (2013.01); *E21B 47/00* (2013.01)

(58) Field of Classification Search

CPC ..... E21B 7/24; E21B 28/00; E21B 31/005; E21B 41/0085

See application file for complete search history.

(56) References Cited

U.S. PATENT DOCUMENTS

| | | | | |
|---|---|---|---|---|
| 6,474,349 | B1 * | 11/2002 | Laker | E21B 37/00 134/22.12 |
| 2005/0205118 | A1 | 9/2005 | Zamfes | |
| 2012/0048621 | A1 * | 3/2012 | Stewart | E21B 7/24 175/56 |
| 2017/0022762 | A1 * | 1/2017 | Larsen | H03H 9/22 |
| 2019/0271202 | A1 | 9/2019 | Saltykov et al. | |
| 2019/0353009 | A1 * | 11/2019 | Nanayakkara | H02K 7/1807 |
| 2019/0383124 | A1 | 12/2019 | Saltykov et al. | |

(Continued)

FOREIGN PATENT DOCUMENTS

| | | | |
|---|---|---|---|
| CN | 112576215 | A | 3/2021 |
| EP | 0841982 | B1 | 10/2002 |

OTHER PUBLICATIONS

J.H.B. Glansbeek et al.; "Ultrasonics Technology: Creating a New Approach to Drill Cuttings Disposal", Society of Petroleum Engineers; SPE 48983; Sep. 1998; pp. 199-205 (7 pages).

(Continued)

*Primary Examiner* — Tara Schimpf
*Assistant Examiner* — Lamia Quaim
(74) *Attorney, Agent, or Firm* — Osha Bergman Watanabe & Burton LLP

(57) ABSTRACT

An ultrasonic system for downhole cleaning of a wellbore includes: an ultrasonic generator that generates high-frequency electric power; a measurement device that monitors electrical parameters related to operation of the ultrasonic system; and an ultrasonic emitter including one or more transducers that break drill cuttings in the wellbore. The ultrasonic emitter is disposed on a Bottom Hole Assembly (BHA) and breaks the drill cuttings made by the BHA in drilling operations.

9 Claims, 4 Drawing Sheets

(56) References Cited

U.S. PATENT DOCUMENTS

2022/0301740 A1* 9/2022 Matlack ..... H01B 9/006

OTHER PUBLICATIONS

D.E. Gaddy, "Ultrasonic processor reduces drill-cuttings size and eliminates subsea mounds," Technology, Oil & Gas Journal, pp. 80-81, Oct. 6, 1997 (2 pages).
R. Nguele, et al., "Effect of ultrasound irradiation on asphaltene aggregation and implications to rheological behavior of bitumen," Ultrasonics Sonochemistry, 2021 (10 pages).
O. G. Gunal, et al., "Alteration of asphaltic crude rheology with electromagnetic and ultrasonic irradiation," Journal of Petroleum Science and Engineering, 2000 (10 pages).
Wei-An Wang, et al., "Investigation of regulating rheological properties of water-based drilling fluids by ultrasound," Petroleum Science, 2021 (11 pages).
X. Luo, et al., "Recent advances in applications of power ultrasound for petroleum industry," Ultrasonics—Sonochemistry, 2021 (11 pages).
J. Rajaguru, et al., "Effect of ultrasonic vibration on the performance of deep hole drilling process," Procedia Manufacturing, 2021 (8 pages).

* cited by examiner

USE OF HIGH-POWER ULTRASOUND FOR IMPROVED HOLE CLEANING IN DRILLING OPERATIONS

BACKGROUND

Hydrocarbon fluids are often found in hydrocarbon reservoirs located in porous rock formations below the surface of the Earth. Wells are drilled into the reservoirs to access and produce the hydrocarbon fluids. Due to the slim-hole size and other operational constraints in Under-Balanced Coiled-Tubing Drilling (UBCTD), efficient hole cleaning by conventional fluid circulation may be a challenge. UBCTD may encounter drilling issues such as pipes becoming jammed in the wellbore (i.e., stuck-pipe incidents). Accordingly, properly cleaning the drilling hole to remove drill cuttings would be important. Conventionally, drilling mud has been used for this purpose. Herein, other methods will be described to tackle the drill cuttings and avoid issues such as the stuck-pipe incidents.

SUMMARY

This summary is provided to introduce a selection of concepts that are further described below in the detailed description. This summary is not intended to identify key or essential features of the claimed subject matter, nor it is intended to be used as an aid in limiting the scope of the claimed subject matter.

This disclosure presents, in accordance with one or more embodiments, an ultrasonic system for downhole cleaning of a wellbore. The ultrasonic system includes: an ultrasonic generator that generates ultrasonic-frequency electric power; a measurement device that monitors electrical parameters related to operation of the ultrasonic system; and an ultrasonic emitter including one or more transducers that break drill cuttings in the wellbore. The ultrasonic emitter is disposed on a Bottom Hole Assembly (BHA) and breaks the drill cuttings made by the BHA in drilling operations.

In another aspect, this disclosure also presents, in accordance with one or more embodiments, a method for operating an ultrasonic system for downhole cleaning of a wellbore. The method includes: disposing an ultrasonic emitter of the ultrasound system on a BHA; generating ultrasonic-frequency electric power via an ultrasonic generator of the ultrasonic system; monitoring electrical parameters related to the operation of the ultrasonic system via a measurement device; breaking drill cuttings in the wellbore via the ultrasonic emitter of the ultrasonic system, wherein the ultrasonic emitter includes one or more transducers.

Other aspects and advantages of the invention will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
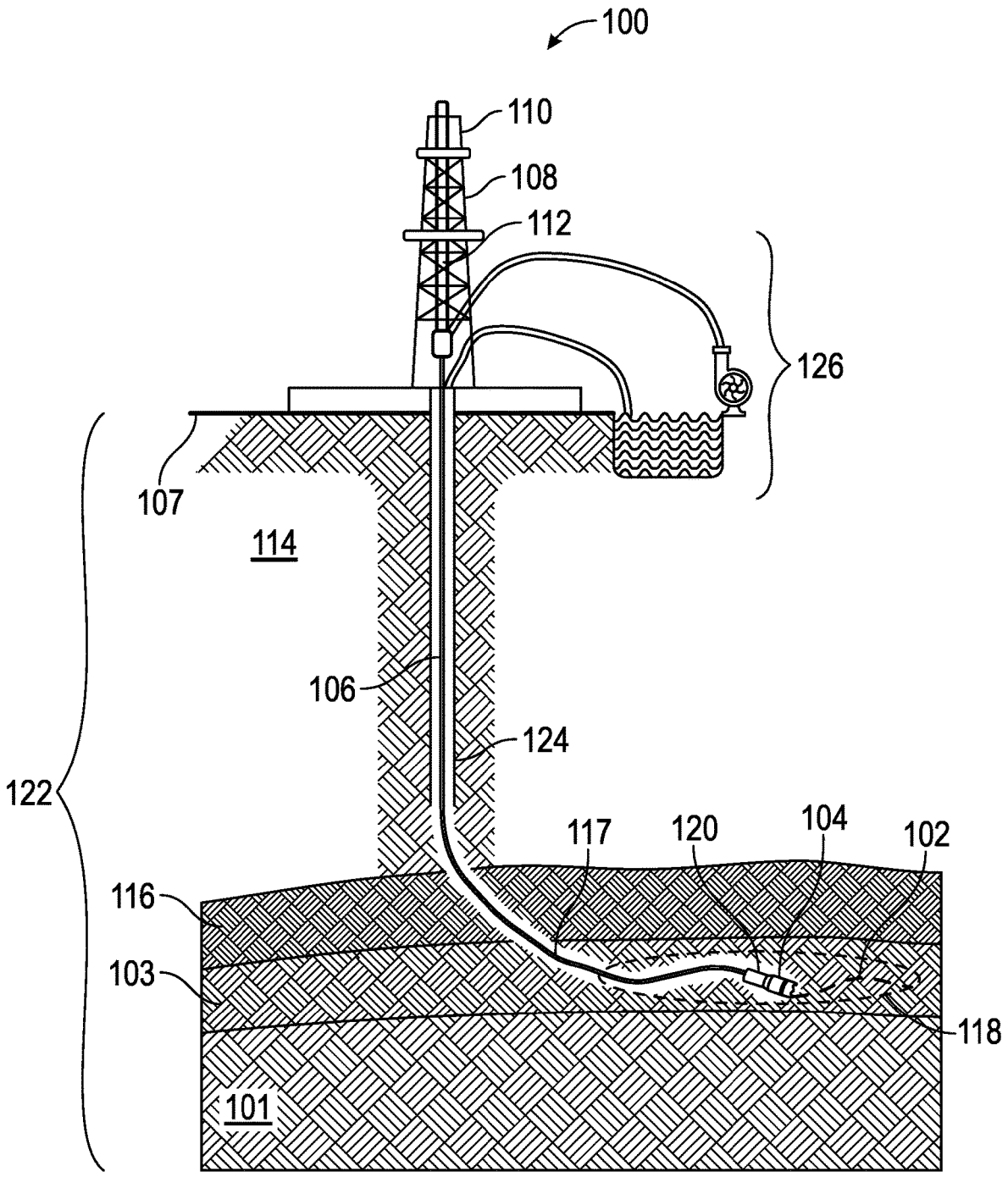
FIG. 1 shows an exemplary well.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the disclosure, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements. In addition, throughout the disclosure, "or" is interpreted as "and/or," unless stated otherwise.

Ultrasonic devices have been widely used in industry. For example, in the oil and gas industry ultrasonic devices have been used for acquiring logging data via imaging tools or for wellbore stimulation. However, one or more the embodiments disclosed herein describe a downhole ultrasonic emitter that is disposed on (assembled to) a bottom hole assembly (BHA) that includes a drill bit. Hereinafter, the downhole ultrasonic emitter will be referred to as "ultrasonic emitter." Accordingly, the ultrasonic emitter can operate alongside the BHA in a bottom portion of a wellbore. In one or more embodiments, other tools or devices can be attached to the ultrasonic emitter to perform operations simultaneously with the ultrasonic emitter, or at least without having to pull out the tools or devices from the bottom portion of the wellbore. In other words, there would be no need to pull out the BHA from the wellbore and replace it with the ultrasonic emitter, because the ultrasonic emitter can be assembled on the BHA that includes the drill bit.

The ultrasonic system described herein in accordance with one or more embodiments provides advantages such as reduction of non-productive time (NPT), less operation pauses and issues due to debris accumulation in the wellbore, continuous operations assurance, using less recirculation mud, and extending the lifetime of the recirculation mud.

The ultrasonic system described herein in accordance with one or more embodiments is compatible with coiled tubing operations. Most current oil and gas tools can be conveyed into the wellbore using coiled tubing, especially for horizontal wells. Further, the ultrasonic system can operate in high pressure and temperature. For example, the operating pressure can be between 30-50 Megapascal (MPa) and the operating temperature can be up to 180-200° C.

While the ultrasound system disclosed in accordance with one or more embodiments is described with reference to Under-Balanced Coiled-Tubing Drilling (UBCTD) operations, one of ordinary skill in the art would acknowledge that the ultrasound system can be adjusted for compatibility with other technologies and operations.

One or more embodiments disclosed herein describe a high-power ultrasonic system to improve hole cleaning while drilling a wellbore, for example for slim-hole drilling such as UBCTD. The ultrasonic system can break rocks and drill cuttings into smaller pieces. The smaller pieces may be easier to flush to outside of the wellbore using the drilling mud. To this end, an ultrasonic emitter is disposed on a BHA that may include a drill bit. The ultrasonic emitter can break the drill cuttings without needing to remove the BHA to be replaced with the ultrasonic emitter. The ultrasonic emitter can be assembled on the BHA before penetrating the BHA into the wellbore and can stay in the wellbore with the drill bit and during operation of the drill bit. This saves time and cost for drilling operations because there may be no need to remove the BHA from the wellbore, where the drilling occurs, to separately clean the wellbore. In addition, the ultrasonic system in accordance with one or more embodiments disclosed herein may reduce the risk of entrapment of pipes or the drill bit inside the wellbore.

For better understanding the ultrasonic system, embodiments of an exemplary well is described below with reference to FIG. 1.

FIG. 1 shows a drilling system (100) in accordance with one or more embodiments. Although the drilling system (100) shown in FIG. 1 is used to drill a wellbore on land, the drilling system (100) may also be a marine wellbore drilling system. The example of the drilling system (100) shown in FIG. 1 is not meant to limit the invention.

As shown in FIG. 1, a wellbore path (102) may be drilled by a drill bit (104) attached by a drillstring (106) to a drill rig located on the surface (107) of the earth. The drill rig may include framework, such as a derrick (108) to hold drilling machinery. The top drive (110) sits at the top of the derrick (108) and provides torque, typically a clockwise torque, via the drive shaft (112) to the drillstring (106) in order to drill the wellbore. The wellbore may traverse a plurality of overburden (114) layers and one or more caprock (116) layers to a hydrocarbon reservoir (103) within the subterranean region of interest (101). The well is drilled to follow a wellbore path (102). The wellbore path (102) may be a curved wellbore path (directional well), or a straight wellbore path (vertical or horizontal well). All or part of the wellbore path (102) may be vertical, and some wellbore paths may be deviated or have horizontal sections.

Prior to the commencement of drilling, a wellbore plan may be generated. The wellbore plan may include a starting surface location of the wellbore, or a subsurface location within an existing wellbore, from which the wellbore may be drilled. Further, the wellbore plan may include a terminal location that may intersect with the target zone (118), e.g., a targeted hydrocarbon-bearing formation, and a planned wellbore path (102) from the starting location to the terminal location. In other words, the wellbore path (102) may intersect a previously located hydrocarbon reservoir (103).

The wellbore (117) may be drilled using a drill rig that may be situated on a land drill site, an offshore platform, such as a jack-up rig, a semi-submersible, or a drill ship. The drill rig may be equipped with a hoisting system, such as a derrick (108), which can raise or lower the drillstring (106) and other tools required to drill the well. The drillstring (106) may include one or more drill pipes connected to form conduit and a BHA (120) disposed at the distal end of the drillstring (106). The BHA (120) may include a drill bit (104) to cut into subsurface (122) rock. The BHA (120) may further include measurement tools, such as a measurement-while-drilling (MWD) tool and logging-while-drilling (LWD) tool. MWD tools may include sensors and hardware to measure downhole drilling parameters, such as the azimuth and inclination of the drill bit, the weight-on-bit, and the torque. The LWD measurements may include sensors, such as resistivity, gamma ray, and neutron density sensors, to characterize the rock formation surrounding the wellbore (117). Both MWD and LWD measurements may be transmitted to the surface (107) using any suitable telemetry system, such as mud-pulse or wired-drill pipe, known in the art.

To start drilling, or "spudding in" the well, the hoisting system lowers the drillstring (106) suspended from the derrick (108) towards the planned surface location of the wellbore (117). An engine, such as a diesel engine, may be used to supply power to the top drive (110) to rotate the drillstring (106). The weight of the drillstring (106) combined with the rotational motion enables the drill bit (104) to bore the wellbore.

Casing (124) may be inserted in the well to support the wellbore and to prevent formation fluids entering the wellbore. The near-surface is typically made up of loose or soft sediment or rock, so large diameter casing (124), e.g., "base pipe" or "conductor casing," is often put in place while drilling to stabilize and isolate the wellbore. At the top of the base pipe is the wellhead, which serves to provide pressure control through a series of spools, valves, or adapters. Once near-surface drilling has begun, water or drill fluid may be used to force the base pipe into place using a pumping system until the wellhead is situated just above the surface (107) of the earth.

Drilling may continue without any casing (124) once deeper, or more compact rock is reached. While drilling, a drilling mud system (126) may pump drilling mud from a mud tank on the surface (107) through the drill pipe. Drilling mud serves various purposes, including pressure equalization, removal of drilling cuts, and drill bit cooling and lubrication.

At planned depth intervals, drilling may be paused and the drillstring (106) withdrawn from the wellbore. Sections of casing (124) may be connected and inserted and cemented into the wellbore. Casing string may be cemented in place by pumping cement and mud, separated by a "cementing plug," from the surface (107) through the drill pipe. The cementing plug and drilling mud force the cement through the drill pipe and into the annular space between the casing and the wellbore wall. Once the cement cures, drilling may recommence. The drilling process is often performed in several stages. Therefore, the drilling and casing cycle may be repeated more than once, depending on the depth of the wellbore and the pressure on the wellbore walls from surrounding rock.

A drilling system (100) may be disposed at and communicate with other systems in the well environment. The drilling system (100) may control at least a portion of a drilling operation by providing controls to various components of the drilling operation. In one or more embodiments, the system may receive data from one or more sensors arranged to measure controllable parameters of the drilling operation. As a non-limiting example, sensors may be arranged to measure weight-on-bit, drill rotational speed (RPM), flow rate of the mud pumps (GPM), and rate of penetration of the drilling operation (ROP). Each sensor may be positioned or configured to measure a desired physical stimulus.

As the wellbore becomes deeper, both successively smaller drill bits and casing string may be used. Drilling deviated or horizontal wellbores may require specialized drill bits or drill assemblies. Drilling may be considered complete when a target zone (118) is reached, or the presence of hydrocarbons is established.

In accordance with one or more embodiments, due to the slim-hole size and other operational constraints in UBCTD, efficient hole cleaning by conventional fluid circulation, such as drilling mud, may be a challenge. Adding a high-power ultrasonic emitter to the BHA, that could be run continuously or intermittently while drilling, can break down drill cuttings into finer pieces, which could be removed via the drilling mud or another flushing fluid. In addition, the reduced size of the drill cuttings may allow for better circulation of the drilling mud at an optimal rate and may also ease downstream processes for treating the drilling mud.

Figure 2:
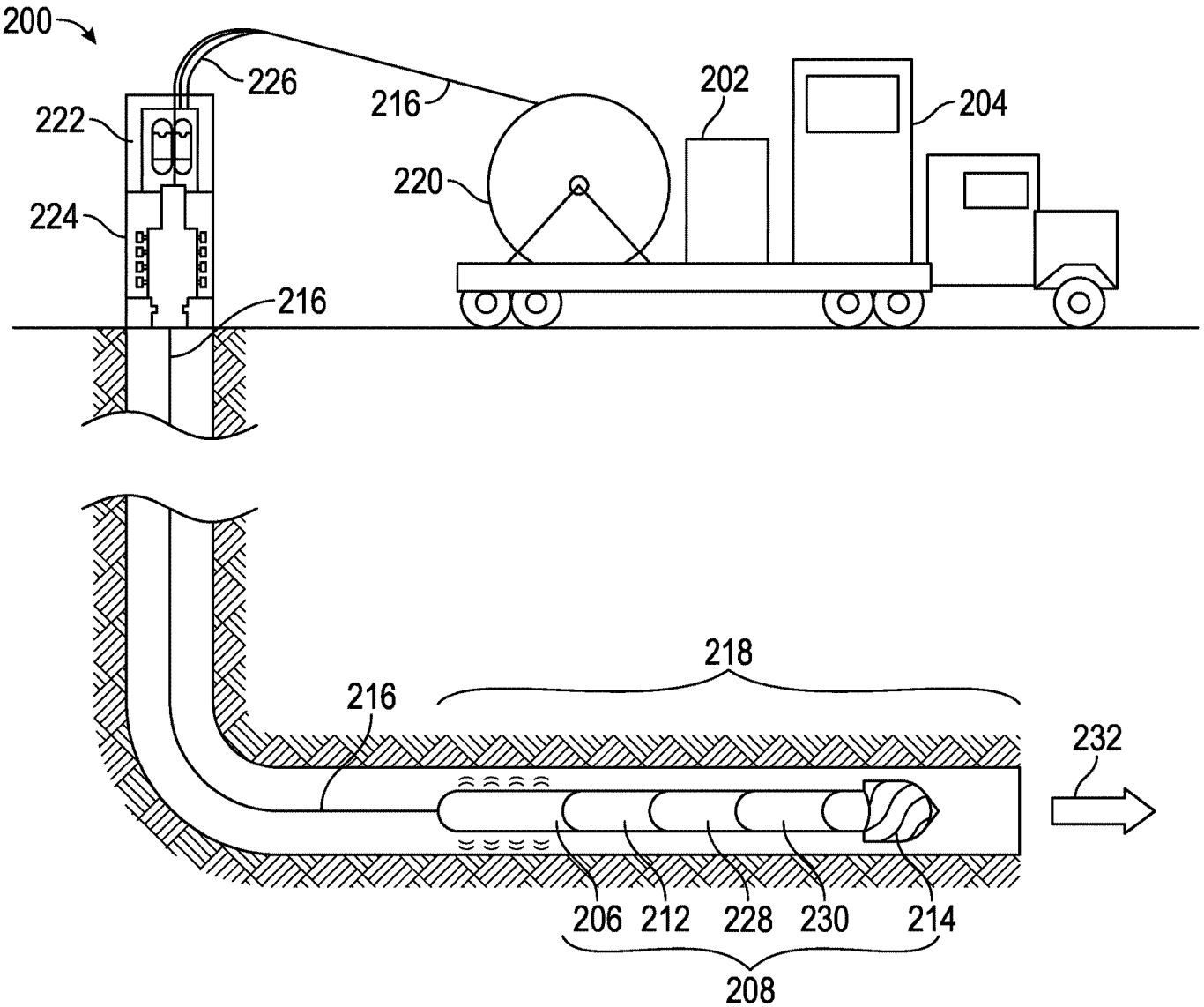
FIG. 2 shows an ultrasonic system for downhole cleaning of a wellbore, in accordance with one or more embodiments disclosed herein.

FIG. 2 shows an ultrasonic system (200) in accordance with one or more embodiments disclosed herein. The ultrasonic system (200) includes a measurement device (204), an ultrasonic generator (202), a long-range multiconductor cable, and an ultrasonic emitter (206). The ultrasonic generator (202) is located outside of the wellbore above the surface of the earth and provides high-power electric power required to work at an ultrasonic frequency (equal to or above 18 kHz). The ultrasonic generator (202) transmits the electric power to the ultrasonic emitter (206) via the multiconductor cable. In other words, the multiconductor cable transports the high-frequency electric power of the ultrasonic generator (202) to the ultrasonic emitter (206). For example the frequency of the high-frequency electric power is equal to or above 18 kHz. The multiconductor cable may be a commercial or a custom-made conductive cable that is capable of transporting electric power at ultrasonic frequencies.

In accordance with one or more embodiments, the ultrasonic generator (202) transforms the frequency of a source of energy to an ultrasonic frequency that is suitable for breaking the drill cuttings. For example, the ultrasonic generator (202) may increase the frequency of its input electricity from the common 50/60 Hertz (Hz) to ultrasonic levels of 20 kHz or above, if required. The ultrasonic generator (202) may be independent from a power source of the drilling rig. Alternatively, the ultrasonic generator (202) may be powered by a motor that derives downhole drilling operations, or any other means, or combinations thereof. For example, the ultrasonic generator (202) may be powered by a diesel generator independently or by a power source shared with the drilling rig.

In accordance with one or more embodiments, the ultrasonic emitter (206) may include one or more high-power ultrasonic transducers each capable of generating a stable acoustic field at, for example, a frequency of 20 kHz and with power of up to 450 W. The ultrasonic emitter (206) may be a modular device that is compatible to be attached to coiled tubing (216) on one side and to other devices or tools on the other side, for example to a BHA (208). In one or more embodiments, the BHA (208) includes a drill bit (214) that drills a wellbore, for example a bottom portion (218) of the wellbore. The BHA (208) includes an orienting device (212) that controls direction/orientation of drilling and BHA (208) movement in the wellbore. The BHA (208) further includes a motor (230) that drives the drill bit (214) and data sensors (228) that measure various conditions of the wellbore. Examples of the data sensors (228) are described above with reference to MWD and LWD with respect to FIG. 1. The high-power ultrasound system (200) can operate in two modes: continuous mode and pulse mode. In the continues mode, the ultrasonic emitter (206) operates continuously creating ultrasonic mechanical waves and a cavitation effect in time, while in the pulse mode, the ultrasonic emitter (206) operates intermittently creating the same mentioned effect of ultrasonic mechanical waves and cavitation in pulses.

The ultrasonic emitter (206) is disposed on the BHA (208) such that a first end of the ultrasonic emitter (206) is attached to the coiled tubing (216) and a second end of the ultrasonic emitter (206) is attached to a first end of the BHA (208). The ultrasonic emitter (206) is disposed on the BHA (208) such that the second end of the ultrasonic emitter (206) is attached to the orienting device (212) disposed at the first end of the BHA (208). The ultrasonic emitter (206) is disposed on the BHA (206) such that the drill bit (214) is disposed on a second end of the BHA (208) after the ultrasonic emitter in a drilling direction (232). The ultrasonic emitter (206) may break the drill cuttings simultaneously with drilling operation of the drill bit (214) of the BHA (208). Alternatively, the ultrasonic emitter (206) may break the drill cuttings intermittently with drilling operation of the drill bit (214). For example, the drill bit (214) or the ultrasonic emitter (206) may start to operate while the other one pauses operation, in an alternative order.

The BHA (208) may be connected to a reel (220) that dispenses the coiled tubing (216) into the wellbore via a guide (226). After when operation of the BHA (208) is finished, the BHA (208) can be pulled out of the wellbore via the coiled tubing (216). The multiconductor cable may be embedded in the coiled tubing (216) for protection and extend all the way from the ultrasonic generator (202) to the ultrasonic emitter (206).

The ultrasonic emitter (206) or the data sensors (228) may send measurement data to a measurement device (204) that is above the surface of the earth. The measurement device may be a computer that includes a processor for processing the measurement data, a memory for storing the measurement data and processing data, a receiver for receiving the measurement data, and a transmitter to transmit instructions/signals to the ultrasonic emitter (206), to the data sensors (228), another device, or a combination of one or more of any of these.

The measurement device (204) monitors electrical parameters related to operation of the ultrasonic system (200). The measurement device (204) monitors the measurement data and can control the ultrasonic emitter (206) based on the measurement data. More specifically, the measurement device (204) measures parameters related to the operation of the ultrasonic system (200) such as parameters related to the ultrasonic emitter (206). The parameters may include impedance, power intensity, or frequency. For example, after determination of the average size of the drill cuttings, based on the measurement data or by sample testing, the power of the ultrasonic emitter (206) can be adjusted to a higher value to break the drilling cuts more desirably into smaller pieces. In another example, the measurement device (204) may determine the texture or type of the drill cuttings, based on the measurement data, and adjust the operation frequency of the ultrasonic emitter (206) to a frequency that is more suitable to break the drill cuttings of that texture or type into smaller pieces.

Upon breaking the drill cuttings into smaller pieces, a fluid such as drilling or recirculating mud may be injected into the wellbore via an injector (222) to flush out the drill cuttings. The injector (222) may be coupled to a pressure containment device (224) that controls the pressure of the injected fluid.

Figure 3:
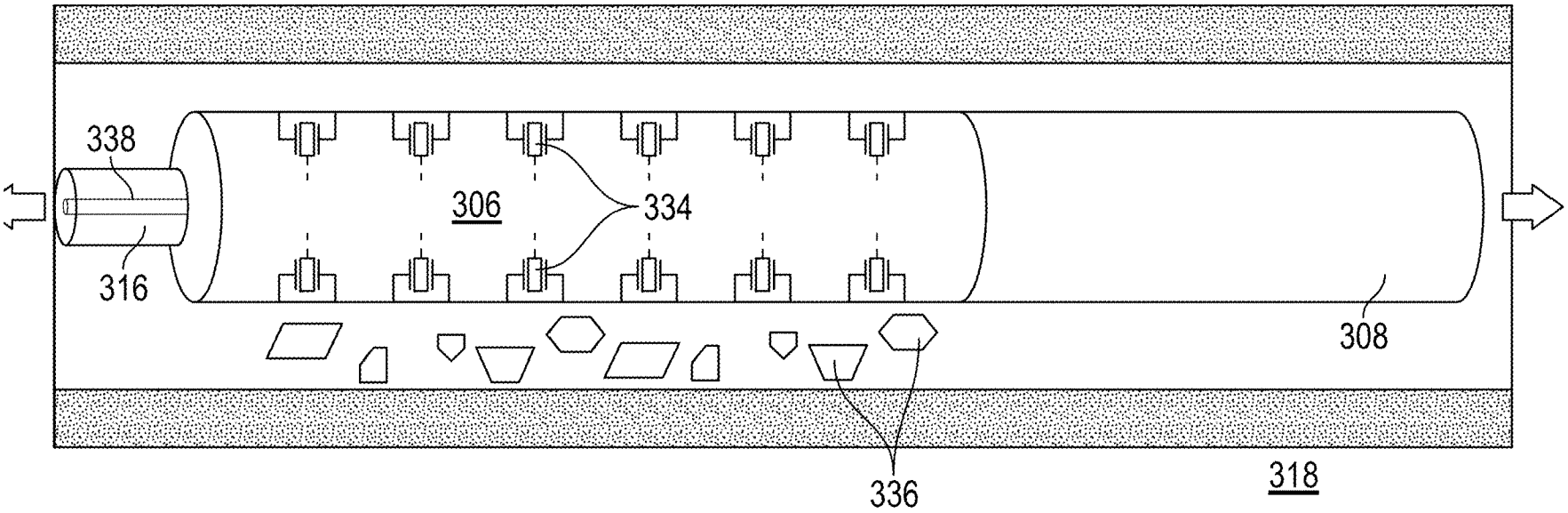
FIG. 3 shows an ultrasonic emitter of an ultrasonic system, in accordance with one or more embodiments disclosed herein.

FIG. 3 shows an ultrasonic emitter (306) in accordance with one or more embodiments disclosed herein. The ultrasonic emitter (306) is attached to a BHA (308) at one end and to the coiled tubing (316) at the other end. The ultrasound emitter (306) may include one or a plurality of ultrasonic transducers (334) that are capable of creating ultrasonic mechanical waves (vibration) and cavitation that can break the drill cuttings (336) produced in the wellbore (318), due to the transmission of the ultrasonic electric power received from the ultrasonic generator. Hereinafter, the ultrasonic transducers will be referred to as "transducers." In one or more embodiments, the transducers (334) may be piezoceramic or piezoelectric transducers. The multiconductor cable (338) embedded in the coiled tubing (316) carries the ultrasonic electric power from the ultrasonic generator to the transducers (334). While twelve transducers (334) are shown in FIG. 3, the number of the transducers (334) is not limited to twelve and can vary depending on the application of the ultrasonic system.

Figure 4:
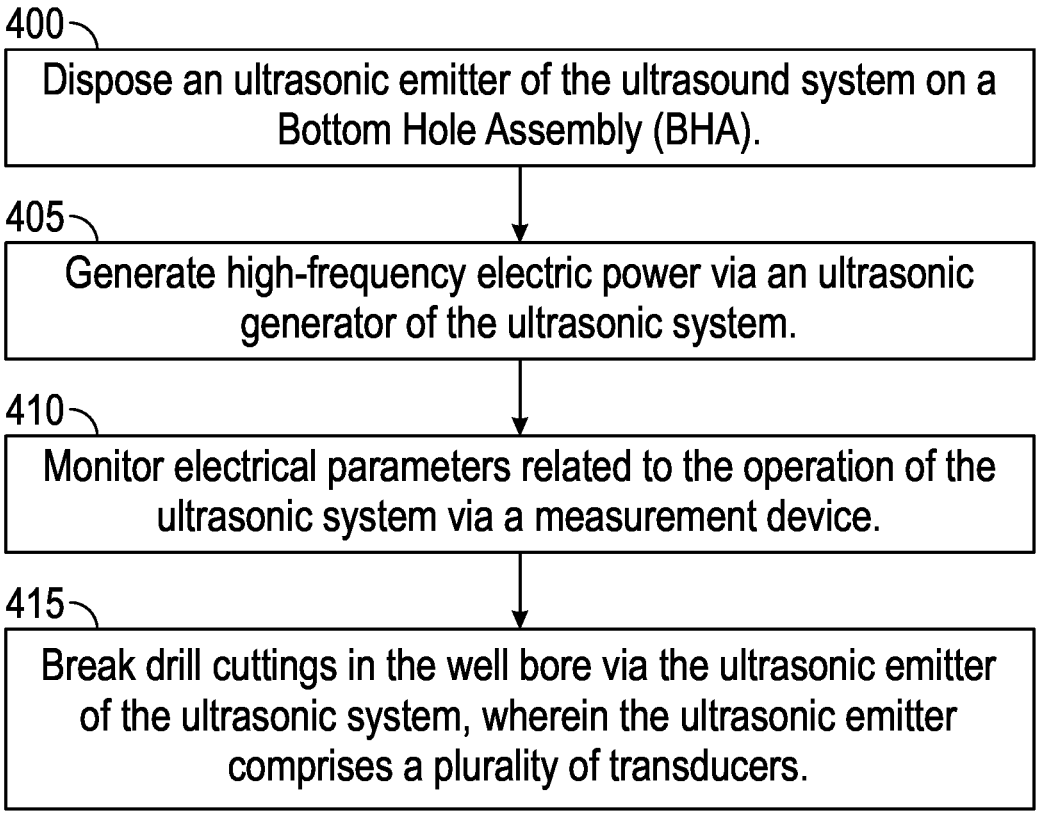
FIG. 4 shows a flow chart for operating an ultrasonic system for downhole cleaning of a wellbore, in accordance with one or more embodiments disclosed herein.

FIG. 4 shows a flowchart for operating an ultrasonic system for downhole cleaning of a wellbore, in accordance with one or more embodiments. In one or more embodiments, one or more of the steps shown in FIG. 4 may be omitted, repeated, and/or performed in a different order than the order shown in FIG. 4. Accordingly, the scope of the invention should not be considered limited to the specific arrangement of the steps shown in FIG. 4. The steps shown in FIG. 4 are explained below.

In Step 400, an ultrasonic emitter of the ultrasound system is disposed on a BHA. Some examples of this step are described above with reference to the ultrasonic emitter (206, 306) and BHA (208, 308) of FIGS. 2 and 3.

In Step 405, high-frequency electric power is generated via an ultrasonic generator of the ultrasonic system. Some examples of this step are described above with reference to the ultrasonic generator (202) of FIG. 2.

In Step 410, electrical parameters related to the operation of the ultrasonic system are continuously monitored via a measurement device during the functioning of the system. Some examples of this step are described above with reference the measurement device (204) of FIG. 2.

In Step 415, the drill cuttings are broken in the wellbore via the ultrasonic emitter of the ultrasonic system. The ultrasonic emitter comprises a plurality of transducers that break the drill cuttings. Some examples of this step are described above with reference to the ultrasonic emitters (206, 306) of FIGS. 2 and 3.

In one or more embodiments, the method is not limited to only the above steps and may include additional steps as well. For example, the method may further include one or more of the following steps: disposing a multiconductor cable in the coiled tubing to transport the ultrasonic-frequency electric power of the ultrasonic generator to the ultrasonic emitter; disposing the ultrasonic generator outside of the wellbore above the surface of the earth; disposing the ultrasonic emitter on the BHA such that an end of the ultrasonic emitter is attached to an end of the BHA; disposing the ultrasonic emitter on the BHA such that the end of the ultrasonic emitter is attached to an orienting device disposed at the end of the BHA; disposing the ultrasonic emitter on the BHA such that a drill bit of the BHA is disposed on the other end of the BHA after the ultrasonic emitter in a drilling direction; disposing the ultrasonic emitter on the BHA such that the other end of the ultrasonic emitter is attached to the coiled tubing; embedding the multiconductor cable in the coiled tubing; breaking the drill cuttings via the ultrasonic emitter simultaneously with drilling operation of the drill bit of the BHA; or generating an acoustic field at a frequency of 20 kilohertz (kHz) and with power of up to 450 Watts (W) via one or more of the transducers.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An ultrasonic system for downhole cleaning of a wellbore, the ultrasonic system comprising:

an ultrasonic generator that generates ultrasonic-frequency electric power;

a measurement device that monitors impedance, power intensity, or frequency of the ultrasonic system; and an ultrasonic emitter comprising one or more transducers that break drill cuttings in the wellbore, wherein the ultrasonic emitter is disposed on a Bottom Hole Assembly (BHA) and breaks the drill cuttings made by the BHA in drilling operations, wherein the ultrasonic emitter is disposed on the BHA such that a first end of the ultrasonic emitter is attached to a first end of the BHA, wherein the ultrasonic emitter is disposed on the BHA such that the first end of the ultrasonic emitter is attached to an orienting device that is disposed between the ultrasonic emitter and a drill bit, and data sensors that measure conditions of the wellbore are disposed between the orienting device and the drill bit, wherein the orienting device controls orientation of drilling and BHA movement in the wellbore; and wherein the measurement device is configured to adjust the ultrasonic emitter based on the impedance, power intensity, or frequency.

2. The ultrasonic system of claim 1, further comprising a multiconductor cable that transports the ultrasonic-frequency electric power of the ultrasonic generator to the ultrasonic emitter.

3. The ultrasonic system of claim 2, wherein the ultrasonic generator is disposed outside of the wellbore above the surface of the earth.

4. The ultrasonic system of claim 1, wherein the ultrasonic emitter is disposed on the BHA such that the drill bit of the BHA is disposed at a second end of the BHA that is at an opposite side of the first end of the BHA, after the ultrasonic emitter in a drilling direction.

5. The ultrasonic system of claim 1, wherein the ultrasonic emitter is disposed on the BHA such that a second end of the ultrasonic emitter that is at an opposite side of the first end of the ultrasonic emitter is attached to a coiled tubing.

6. The ultrasonic system of claim 5, wherein a multiconductor cable that transports the ultrasonic-frequency electric power of the ultrasonic generator to the ultrasonic emitter is embedded in the coiled tubing.

7. The ultrasonic system of claim 1, wherein the ultrasonic emitter breaks the drill cuttings simultaneously with drilling operation of the drill bit of the BHA.

8. The ultrasonic system of claim 1, wherein the one or more transducers generate acoustic field at a frequency of 20 kHz and with power of up to 450 W.

9. A method for operating an ultrasonic system for downhole cleaning of a wellbore, the method comprising:

disposing an ultrasonic emitter of the ultrasound system on a Bottom Hole Assembly (BHA) such that:

a first end of the ultrasonic emitter is attached to a first end of the BHA;

the first end of the ultrasonic emitter is attached to an orienting device that is disposed between the ultrasonic emitter and a drill bit; and data sensors that measure conditions of the wellbore are disposed between the orienting device and the drill bit, wherein the orienting device controls orientation of drilling and BHA movement in the wellbore;

generating ultrasonic-frequency electric power via an ultrasonic generator of the ultrasonic system;

monitoring impedance, power intensity, or frequency of the ultrasonic system via a measurement device;

wherein the measurement device is configured to adjust the ultrasonic emitter based on the impedance, power intensity, or frequency; and breaking drill cuttings in the wellbore via the ultrasonic emitter of the ultrasonic system, wherein the ultrasonic emitter comprises one or more transducers.

* * * * *